United States Patent [19]

Wolens et al.

[11] Patent Number: 4,777,737

[45] Date of Patent: Oct. 18, 1988

[54] APPARATUS FOR DRYING GARMENTS

[76] Inventors: John Wolens, 40 Hazel Ave., Glencoe, Ill. 60022; Nancy McGee, 44 Lawton Rd., Riverside, Ill. 60546

[21] Appl. No.: 48,238

[22] Filed: May 11, 1987

[51] Int. Cl.[4] ..... F26B 9/10

[52] U.S. Cl. ..... 34/237; 34/239; 34/151

[58] Field of Search ..... 219/369, 366, 370, 400; 34/238, 151, 158, 239, 237

[56] References Cited

U.S. PATENT DOCUMENTS 2,274,104 2/1942 Stanley ..... 34/238

3,629,953 12/1971 Fleming ..... 34/158

*Primary Examiner*—Larry I. Schwartz

*Attorney, Agent, or Firm*—Niro, Scavone, Haller, Niro & Rockey, Ltd.

[57] ABSTRACT

A novel portable garment drying device for quickly drying garments is comprised of an air circulating means such as a squirrel cage fan, connected to a support frame composed of hollow tubing with holes for directing air inside the perimeter of the assembled tubing, an air permeable sheet upon which a garment is placed for drying, and means for attaching the sheeting to the support frame. The device is easily assembled and disassembled.

4 Claims, 1 Drawing Sheet

APPARATUS FOR DRYING GARMENTS

BACKGROUND OF THE INVENTION

This invention relates to a light, portable device for drying garments, such as wool or cotton sweaters, gloves, scarfs, and other delicate apparel.

The current state of the art in drying individual garments, such as sweaters, is remarkably limited. One can place such garments in a dryer on a stationary shelf or in a tumbling mode to dry the garment. Obviously dryers are not portable, and frequently the temperature control mechanism is such that the temperature in the dryer cannot be maintained at a low enough temperature to prevent shrinking.

Other alternatives to drying such garments are equally unsatisfactory. Placing a sweater on a hanger and letting it drip dry requires a substantial amount of time and can result in the undesired distortion of the garment's original shape. Placing a wet garment on a towel on a flat surface is a very slow process. Commercial devices that are currently marketed also are too slow. For example, there are available so-called sweater dryers that include a screen stretched on a frame so that a garment placed on the screen has both its front and back exposed to the air for drying. One must depend, however, on ambient air current and simple evaporation to accomplish the drying.

SUMMARY OF THE INVENTION

The purpose of this invention is to provide a portable device that can be moved easily throughout a household or disassembled and carried on trips. The invention provides a flow of air at ambient or slightly elevated temperature to dry garments without shrinking. The shape of the garment is also preserved. This invention provides, at low cost, an apparatus that substantially increases the drying time of a wet garment.

The garment dryer is comprised of a support frame covered by an air permeable sheet means, such as nylon netting. An air circulating means such as a fan is connected to the frame so that air is directed through the frame. Apertures on the inside perimeter of the frame direct air under, through and around a garment placed upon the sheet means, so that the drying of the garment is accelerated.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings in which:

DESCRIPTION OF THE PREFERRED EMBODIMENT

A portable garment dryer 10 includes an air circulating means 11 such as a fan enclosed inside a fan housing 11A. Preferably, the fan is a 12 volt "squirrel cage" fan that can be adapted to operate from the power provided by either a battery source or from a standard wall socket. In addition, one or more electric heating coils 11B can be placed inside the fan housing to slightly heat the air that is used to dry the garment. Using heating coils is an optional embodiment; air that is too hot can shrink the garment. The fan housing 11A has two air outlets 12 that connect to a support frame 13.

Figure 3:
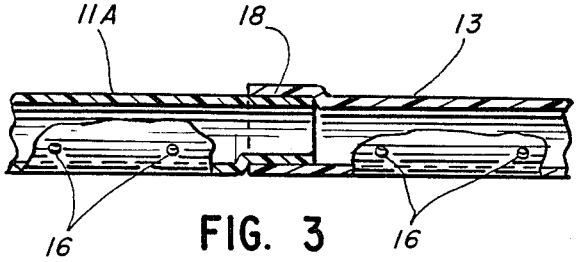
FIG. 3 depicts the press-fit telescoping connection of the segments of the frame.
Figure 4:
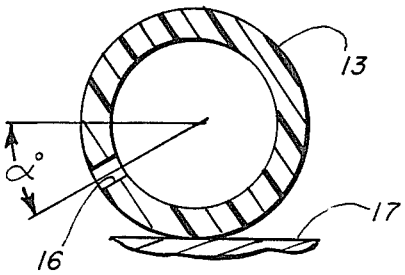
FIG. 4 depicts the preferred location of the air directing means in the support frame.

The support frame 13 is comprised of several segments 13A–13E. Each segment is connected at a joint 18. Each segment of the support frame is preferably made from cylindrical tubing such as aluminum, polyvinyl chloride (PVC), or any other lightweight material. The joint 18 between segments is made by press-fitting, or telescoping, a male and female end of the support frame segment together as shown in FIG. 3.

When the support frame is assembled, an air permeable sheet means such as a netting or screen 15 is placed over the support frame 13. The screen 15 is attached to the support frame 13 by attachment means 14. The attachment means can comprise any one of numerous well-known mechanical devices. For example, a plurlatiy of pieces of velcro attached to the perimeter of the screen 14 can be mated to a corresponding plurality of pieces of velcro attached to the support frame 13. Another attachment means 14 could consist of mechanical snaps, or still another means might be a plurality of posts on the support frame that correspond to a plurality of holes in the edge of the netting, whereby the holes in the netting are hooked over the small posts on the support frame 13. The screen 15 can be a wide mesh item comprised of criss-crossing inexpensive nylon or plastic string. The edges of the netting 15 should have a durable cloth or plastic border which contains one part of the attachment means 14.

Figure 1:
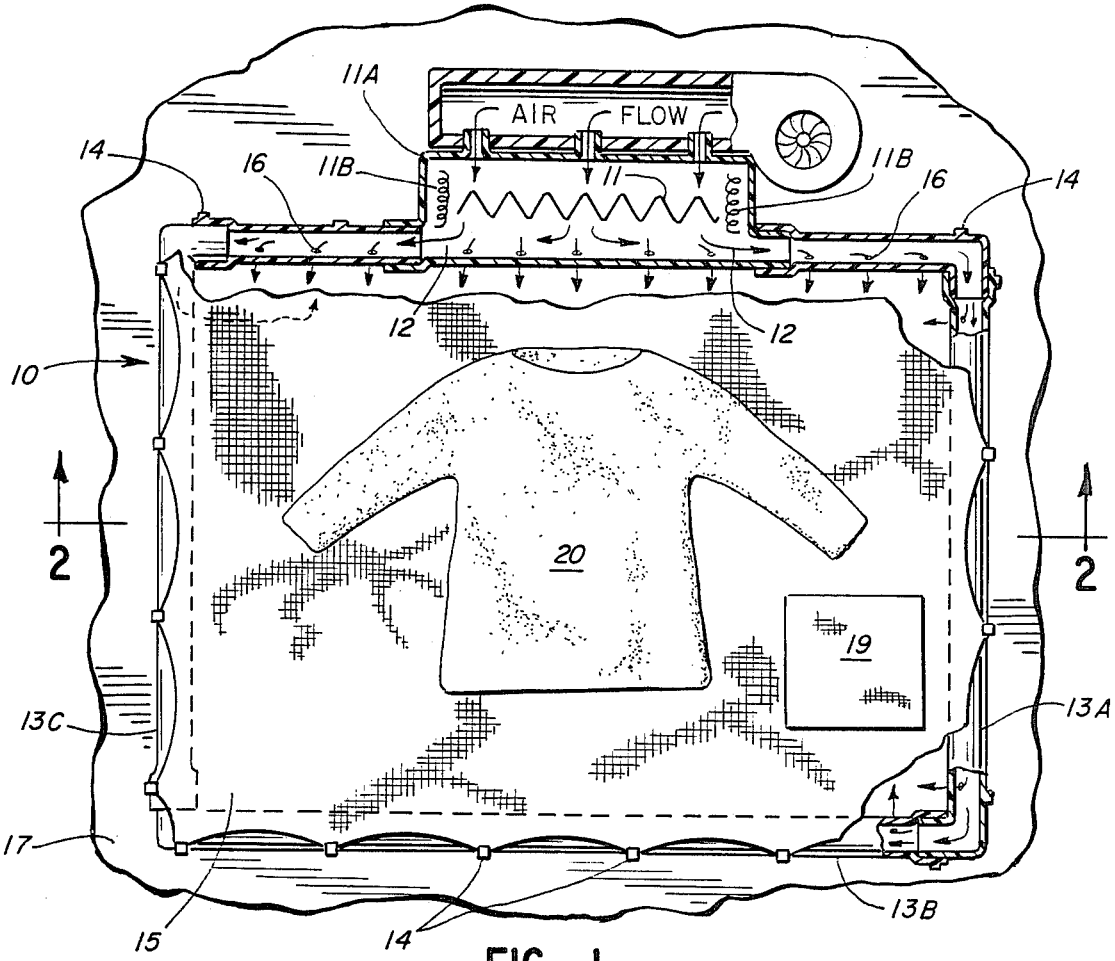
FIG. 1 is a plan view of one preferred form of the invention.
Figure 2:
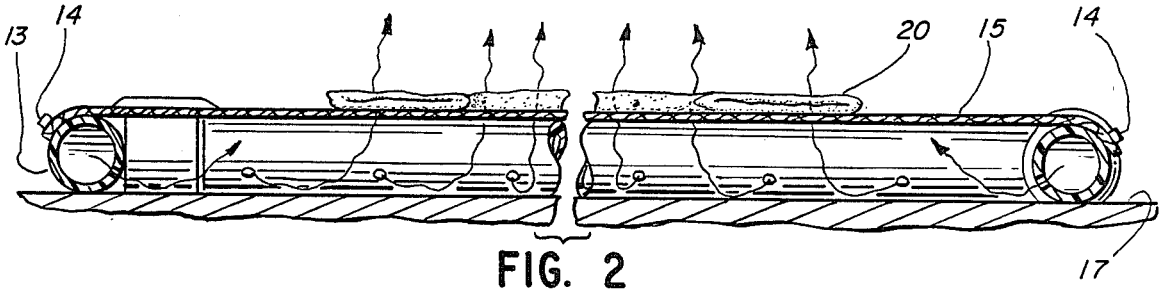
FIG. 2 is a sectional view taken along line 2—2 of FIG. 1.

To dry a garment 20, the garment 20 is placed upon the netting 15 of the assembled device 10. The device 10 is placed on an underlying or supporting surface such as a counter top 17, as shown in FIG. 2. If desired, a towel can also be placed under the support frame 13 to absorb any moisture dripping from the garment 20. After placing the garment 20 upon the netting 15, additional pieces of air blocking material 19 can also be placed on the screen 15. The air blocking material 19 prevents air from escaping from under the screen 15 before it has passed under the garment 20 and had a drying effect.

The actual drying of the garment occurs when power is supplied to the fan 11 and air begins to flow through the fan housing air outlet 12 and into the support frame 13. The air passing through the hollow support frame 13 escapes through air directing means 6 which consist of a plurality of openings spaced in the support frame 13. Ideally, the air directing means 16 are angled downward, slightly below horizontal. This creates some turbulence in the air under the netting 15 which increases the drying effect of the device. The angle of the air directing means 16 also prevents the air from escaping from under the screen 15 while it is still close to the support frame 13 and thus has not exerted a drying effect upon the garment 20.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore intended that such changes and modifications be covered by the following claims.

What is claimed is:

1. A portable apparatus for drying a garment which may be easily assembled and disassembled, said apparatus comprising:

an air permeable sheet means for holding said garment;

a tubular frame engageable and disengageable from said sheet means and for supporting said sheet means above an underlying surface; said sheet, frame and underlying surface together forming a generally enclosed chamber;

said frame having a plurality of segments joinable in telescoping relation;

means for directing a flow of air through said tubular segments around the entire periphery of said chamber, through aperture means into said chamber and up and through said sheet means, whereby said garment is exposed to said air flow to facilitate drying of the garment; and air circulating means mounted to said frame for directing air into said flow directing means.

2. The garment dryer of claim 1 wherein said aperture means directs said air flow into said chamber at an angle below horizontal.

3. The garment dryer of claim 1 further comprising means for heating the circulating air.

4. The garment dryer of claim 1 further comprising pieces of material placed on said sheet around a garment to prevent air from escaping at the perimeter of said garment dryer

* * * * *